US007995780B2

(12) United States Patent
Pedersen et al.

(10) Patent No.: US 7,995,780 B2
(45) Date of Patent: Aug. 9, 2011

(54) HEARING AID WITH FEEDBACK CANCELLATION

(75) Inventors: Brian Dam Pedersen, Ringsted (DK); Erik Lindberg, Hampshire, IL (US)

(73) Assignee: GN ReSound A/S (DK)

( * ) Notice: Subject to any disclaimer, the term of this patent is extended or adjusted under 35 U.S.C. 154(b) by 1050 days.

(21) Appl. No.: 11/506,949

(22) Filed: Aug. 18, 2006

(65) Prior Publication Data

US 2008/0212816 A1 Sep. 4, 2008

Related U.S. Application Data

(63) Continuation of application No. PCT/DK2005/000112, filed on Feb. 18, 2005.

(51) Int. Cl.
*H04R 25/00* (2006.01)
*H04R 15/00* (2006.01)

(52) U.S. Cl. ..... 381/318; 381/94.1; 381/312

(58) Field of Classification Search ..... 381/312, 381/313, 317, 318, 23.1, 71.1, 94.1, 94.9, 381/93, 95, 96, 108; 379/406.01
See application file for complete search history.

(56) References Cited

U.S. PATENT DOCUMENTS

| | | | | |
|---|---|---|---|---|
| 4,357,499 | A | 11/1982 | Bruel | |
| 5,475,759 | A * | 12/1995 | Engebretson | 381/318 |
| 5,619,580 | A | 4/1997 | Hansen | |
| 5,680,467 | A | 10/1997 | Hansen | |
| 6,128,392 | A | 10/2000 | Leysieffer et al. | |
| 6,434,246 | B1 * | 8/2002 | Kates et al. | 381/312 |
| 6,480,610 | B1 | 11/2002 | Fang et al. | |
| 6,498,858 | B2 | 12/2002 | Kates | |
| 6,754,356 | B1 * | 6/2004 | Luo et al. | 381/318 |
| 2002/0094100 | A1 * | 7/2002 | Kates et al. | 381/318 |
| 2005/0047620 | A1 * | 3/2005 | Fretz | 381/318 |
| 2005/0265568 | A1 * | 12/2005 | Kindred | 381/318 |

FOREIGN PATENT DOCUMENTS

| | | |
|---|---|---|
| DE | 10223544 | 7/2003 |
| DE | 10217393 | 11/2003 |
| EP | 1367856 | 5/2003 |
| WO | 0106746 | 1/2001 |

OTHER PUBLICATIONS

Rife et al. "Transfer-Function Measurement with Maximum-Length Sequences". Audio Eng. Soc., vol. 37, No. 6, Jun. 1989.
International Search Report and Written Opinion mailed Dec. 28, 2005 for PCT/DK2005/000112.

* cited by examiner

*Primary Examiner* — Tuan D Nguyen
(74) *Attorney, Agent, or Firm* — Vista IP Law Group, LLP.

(57) ABSTRACT

A hearing aid includes a hearing aid housing enclosing a microphone for converting sound into an audio signal, first feedback compensation means for providing a first feedback compensation signal of signals picked up by the microphone by modeling an internal mechanical feedback signal path of the hearing aid, second feedback compensation means for providing a second feedback compensation signal by modeling an external feedback signal path of the hearing aid, subtracting means for subtracting the first and second feedback compensation signals from the audio signal to form a compensated audio signal, processing means, connected to an output of the subtracting means, for processing the compensated audio signal, and a receiver, connected to an output of the processing means, for converting the processed compensated audio signal into a sound signal.

Figure 1:
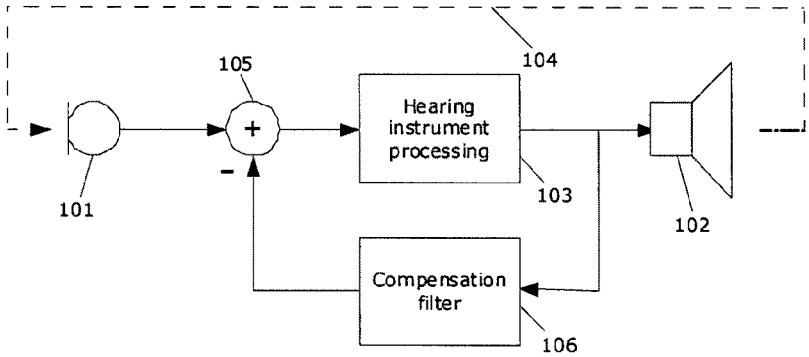

30 Claims, 6 Drawing Sheets
(4 of 6 Drawing Sheet(s) Filed in Color)

HEARING AID WITH FEEDBACK CANCELLATION

RELATED APPLICATIONS

This application is a continuation of PCT Application No. PCT/DK2005/000112 which was filed on 18 Feb. 2005, now expired, which claims priority from Danish Patent Application No. PA 2004 00267 filed on 20 Feb. 2004, the disclosures of both of these applications are expressly incorporated by reference in their entirety herein.

FIELD

The field of the application relates to a hearing aid, especially a hearing aid with feedback cancellation.

BACKGROUND

Feedback is a well known problem in hearing aids and several systems for suppression and cancellation of feedback exist within the art. With the development of very small digital signal processing (DSP) units, it has become possible to perform advanced algorithms for feedback suppression in a tiny device such as a hearing instrument, see e.g. American patents U.S. Pat. No. 5,619,580, U.S. Pat. No. 5,680,467 and U.S. Pat. No. 6,498,858.

The above mentioned prior art systems for feedback cancellation in hearing aids are all primarily concerned with the problem of external feedback, i.e. transmission of sound between the loudspeaker (often denoted receiver) and the microphone of the hearing aid along a path outside the hearing aid device. This problem, which is also known as acoustical feedback, occurs e.g. when a hearing aid ear mould does not completely fit the wearer's ear, or in the case of an ear mould comprising a canal or opening for e.g. ventilation purposes. In both examples, sound may "leak" from the receiver to the microphone and thereby cause feedback.

However, feedback in a hearing aid may also occur internally as sound can be transmitted from the receiver to the microphone via a path inside the hearing aid housing. Such transmission may be airborne or caused by mechanical vibrations in the hearing aid housing or some of the components within the hearing instrument. In the latter case, vibrations in the receiver are transmitted to other parts of the hearing aid, e.g. via the receiver mounting(s). For this reason, the receiver is not fixed but flexibly mounted within some state-of-the-art hearing aids of the ITE-type (In-The-Ear), whereby transmission of vibrations from the receiver to other parts of the device is reduced.

While the problem of external feedback limits the maximum gain available in a hearing aid while in use by a hearing impaired wearer, the problem of internal feedback has its main implications in the production process of hearing aids, where it is today a very time-consuming manual procedure to mount and/or place receiver and microphone(s) in the devices in such a way that internal feedback is minimised.

The continuing minimisation of the size of a hearing aid makes it more and more critical to accurately position the receiver in the hearing aid housing during manufacture or service so that internal feedback is kept at a minimum. This also makes the hearing aid less robust against bumps or impacts against the surroundings that may occur during use of the hearing aid, since a slight displacement of the receiver may cause sufficient internal feedback to significantly reduce the maximum gain made available to the user without howling or whistling of the hearing aid.

Thus, there is a need for an improved hearing aid with a positioning of the receiver that is easy to perform during manufacture or service and that is robust during use without reducing the maximum hearing aid gain made available to the user of the hearing aid.

SUMMARY

According to the present application, the above-mentioned and other objects are fulfilled by a hearing aid, which is capable of compensating for the internal mechanical and/or acoustical feedback within the hearing aid housing. The internal compensation effectively compensates for the mechanical and/or acoustical signals generated within the hearing aid and picked up by the one or more microphones of the hearing aid.

Thus, in a first aspect, a hearing aid is provided comprising a hearing aid housing with a microphone for converting sound into an audio signal, first feedback compensation means for providing a first feedback compensation signal of signals picked up by the microphone by modelling an internal mechanical feedback signal path of the hearing aid, subtracting means for subtracting the first and second feedback compensation signals from the audio signal to form a compensated audio signal, processing means, connected to an output of the subtracting means, for processing the compensated audio signal, and a receiver, connected to an output of the processing means, for converting the processed compensated audio signal into a sound signal.

In a preferred embodiment, the hearing aid further comprises second feedback compensation means for providing a second feedback compensation signal by modelling an external feedback signal path of the hearing aid.

Due to the internal feedback compensation, it is possible to mount the receiver in close contact with the hearing aid housing, i.e. the previously required suspension of the receiver in resilient suspensions within the hearing aid is no longer necessary. The receiver may be snugly fitted within the hearing aid housing, e.g. within a compartment of the hearing aid housing having mechanical support elements abutting the hearing aid when mounted and keeping the receiver in a specific position during use. The internal mechanical and/or acoustical feedback will be suppressed by the first feedback compensation means. The mounting of the receiver is robust against mechanical bumps or impacts that the hearing aid will experience during transport or use. Further, the manufacture of the hearing aid is simplified and less costly and makes it easy to calibrate.

It is to be understood that the microphone can be any type of microphone suitable for use in a hearing aid, such as a pressure microphone or a pressure gradient microphone. Likewise, the receiver may be a standard hearing aid receiver. The processing means may be any kind of analogue or digital signal processor suitable for performing hearing aid processing such as amplification, compression, noise reduction etc. The first and second feedback compensation means model an internal and an external feedback signal path, respectively, so as to form first and second feedback compensation signals, respectively. By subtracting the first and second feedback signals from the audio signal a compensated audio signal is formed, the compensated audio signal corresponding to the input from the microphone substantially without feedback from the two modelled feedback signal paths.

The internal feedback signal path between the microphone and the receiver may comprise a mechanical connection., an acoustical connection, or a combined mechanical and acoustical connection.

Here, the term acoustical refers to sound propagating as pressure waves in a gas, such as ordinary air within the hearing aid, while the term mechanical refers to sound propagating as vibrations through solid materials, such as the hearing aid housing, receiver/microphone mountings etc.

Thus, the internal feedback signal path may comprise mechanical elements in the hearing aid, such as receiver, microphone, mountings and housing, and in some cases, also an acoustical element, such as air within the hearing aid.

The external feedback signal path is preferably an acoustic path between the microphone and the receiver, i.e. an external feedback signal propagates through air surrounding the hearing aid.

Preferably, the first feedback compensation means comprises a static filter, preferably a digital static filter, the static filter having an impulse response based on an estimate of the internal feedback path's impulse response.

Alternatively, the first feedback compensation means may comprise an adaptive filter, i.e. a filter that changes its impulse response in accordance with changes in the internal feedback path.

Preferably, the second feedback cancellation means comprises an adaptive filter, such as an LMS adaptive system.

Both static and adaptive filters are well known to a person skilled in the art of hearing aids, and will therefore not be discussed in further detail here.

The external feedback path extends "around" the hearing aid and is therefore usually longer than the internal feedback path, i.e. sound has to propagate a longer distance along the external feedback path than along the internal feedback path to get from the receiver to the microphone. Accordingly, when sound is emitted from the receiver, the part of it propagating along the external feedback path will arrive at the microphone with a delay in comparison to the part propagating along the internal feedback path. Therefore, it is preferable that the first and second feedback compensation means operate on first and second time windows, respectively, and that at least a part of the first time window precedes the second time window. Whether the first and second time windows overlap or not, depends on the length of the impulse response of the internal feedback path.

It is an advantage that the first and second feedback compensation means may each effectively model a feedback signal path of their own taking the characteristics, such as frequency response and time-dependent variation, of that specific feedback signal path into consideration.

The hearing aid may further comprise a test signal generator for generating a test signal for emission via the receiver, wherein the processing means comprises a program for recording a feedback signal upon emission of the test signal, estimating, based on at least a part of said feedback signal, a model of at least a part of a corresponding feedback signal path, and transferring the estimate to the first feedback cancellation means.

For example, the first feedback compensating means may comprise an adaptive filter that is allowed to adapt during emission of the test signal by the receiver. Upon completion of the emission of the test signal, e.g. when the changes of the filter coefficients have become less than a predetermined limit, the filter coefficients are kept constant, i.e. the adaptive filter is changed into a static filter with the filter coefficients that have been determined by the adaptive filter during emission of the test signal.

Alternatively, the recorded feedback signal may be uploaded to an external computer that is adapted for estimating the model of at least a part of the internal mechanical and/or acoustical feedback signal path and for transferring the estimate to the first feedback cancellation means, e.g. by downloading determined filter coefficients.

To obtain a good estimate of the internal feedback path, it is necessary to arrange the hearing aid with the internal feedback path only, i.e. external feedback and surrounding noise should not be present. One way to do this is to place the device on a coupler (ear simulator) to provide an acoustic impedance to the receiver that is substantially similar to that provided by a wearer's ear. Leaks such as vents in In-The-Ear (ITE) devices must be sealed, and the device placed in an anechoic test box to eliminate sound reflections and/or noise from the surroundings. Now, an estimated model of the internal feedback path may be obtained by allowing the hearing aid to generate the test signal emitted by the receiver and then record the corresponding feedback signal from the microphone. From the recorded feedback signal the mechanical feedback path can be estimated. Preferably, the filter coefficients for the obtained model is then stored in a memory of the hearing aid and may be used during operation.

The test signal is preferably a Maximum Length Sequence (MLS) or a broadband noise signal. For details on MLS, reference is made to Douglas D. Rife and John Vanderkooy, "Transfer-Function Measurement with Maximum-Length Sequences", Journal of the Audio Engineering Society, Vol. 37, Number 6 pp. 419 (1989). This disclosure presents a comprehensive analysis of transfer-function measurement based on maximum-length sequences (MLS). MLS methods employ efficient cross correlations between input and output to recover the periodic impulse response (PIR) of the system being measured.

According to a second aspect, a method for cancellation of feedback in a hearing aid, said hearing aid at least comprising a microphone and hearing aid processing means, includes: generating a first feedback compensation signal by modelling an internal feedback signal path of the hearing aid, generating a second feedback compensation signal by modelling an external feedback signal path of the hearing aid, and subtracting the first and second feedback compensation signals from an audio signal provided by the microphone prior to feeding the audio signal to the hearing aid processing means.

According to a third aspect, a method for producing a hearing aid, said hearing aid at least comprising a microphone, a test signal generator, first feedback compensation means and a receiver, includes: assembling the hearing aid, generating a test signal and emitting said test signal by means of the receiver, registering a feedback signal corresponding to the test signal as fed back from the receiver to the microphone, and programming, based on at least a part of said feedback signal, the first feedback compensation means to model at least a part of a feedback signal path between the receiver and the microphone.

Preferably, before generating and emitting the test signal, the hearing aid is placed in an acoustic coupler simulating an ear, the acoustic coupler being arranged in an anechoic chamber, and any vents of the hearing aid are sealed.

It is an advantage that the hearing aid is itself able to generate a test signal and, based on a recorded feedback signal, program the first feedback cancellation means to model the estimated feedback signal path.

It is to be understood that the above may be performed automatically during production of a hearing aid, i.e. prior to distribution to audiologists and hearing impaired patients.

It is an advantage that the hearing aid can automatically estimate a feedback signal path, such as an internal feedback signal path, and program the feedback compensation means to model at least a part of this feedback signal path, as an automated part of the production process since less manual testing and adjustment of the hearing aid will be necessary.

DESCRIPTION OF THE DRAWING FIGURES

The patent or application file contains at least one drawing executed in color. Copies of this patent or patent application publication with color drawing(s) will be provided by the Office upon request and payment of the necessary fee.

The application will now be described in further detail with reference to the accompanying drawings.

Figure 2:
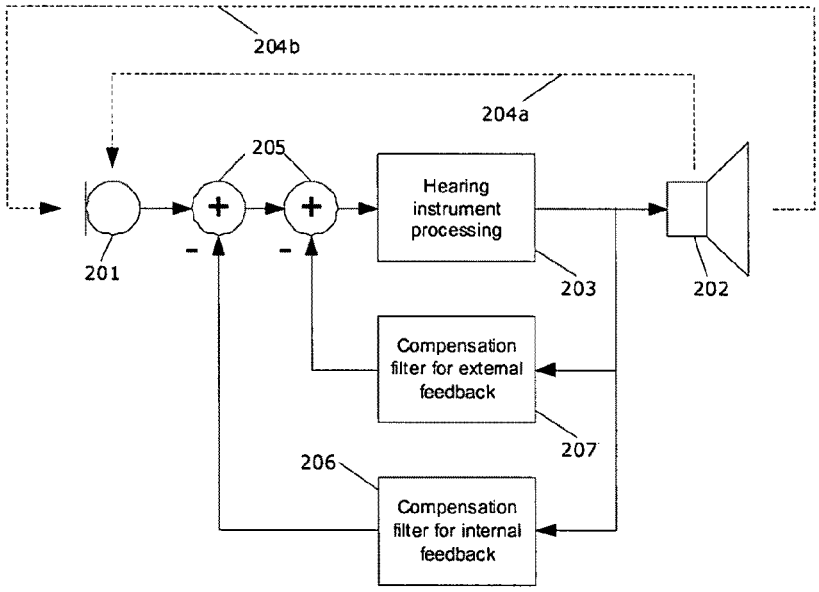
Figure 3:
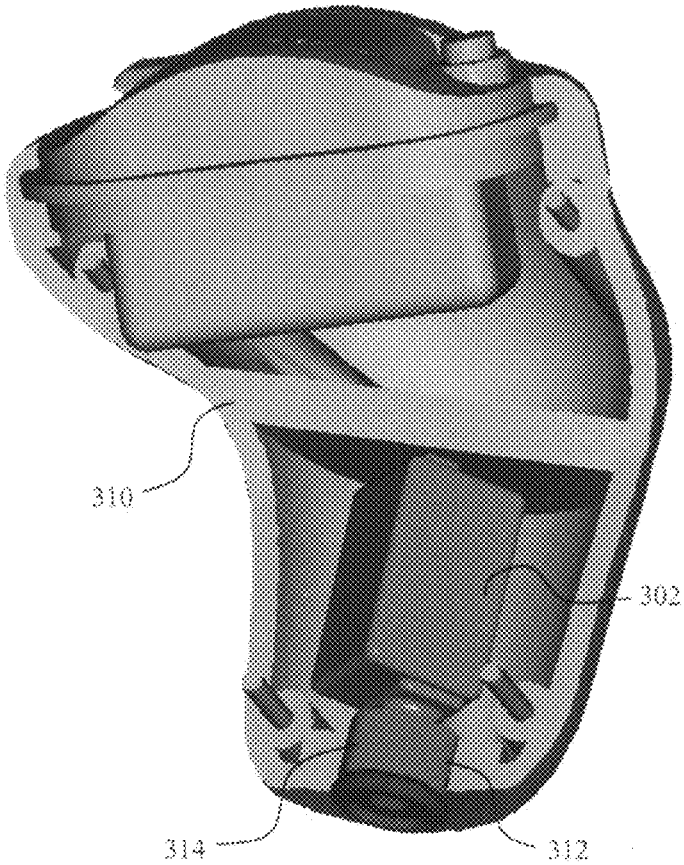
Figure 4:
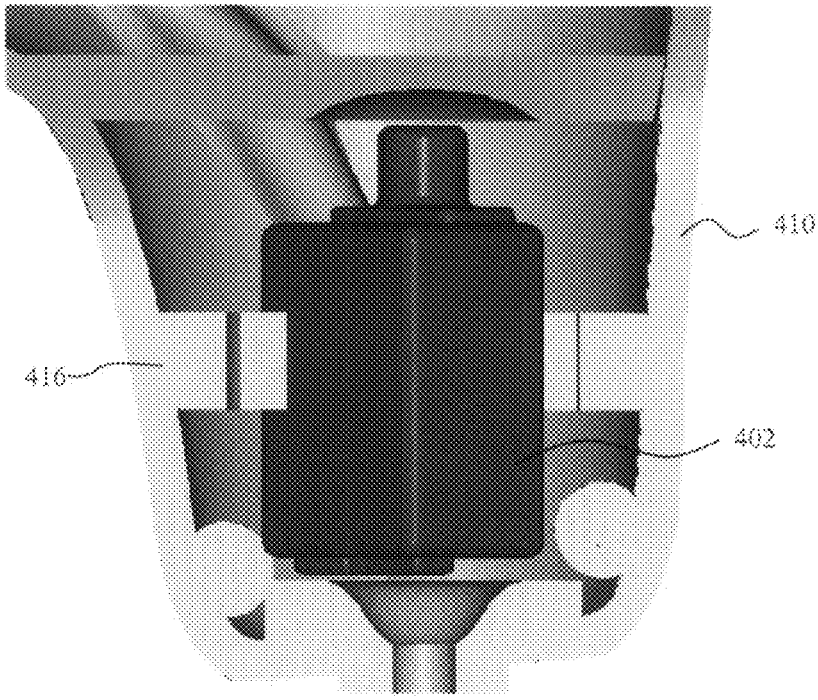
Figure 5:
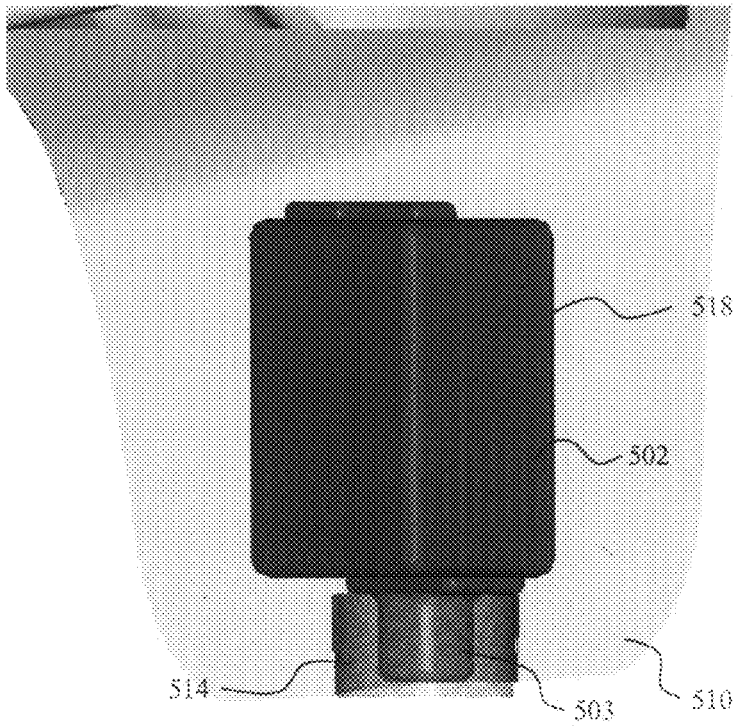
Figure 6:
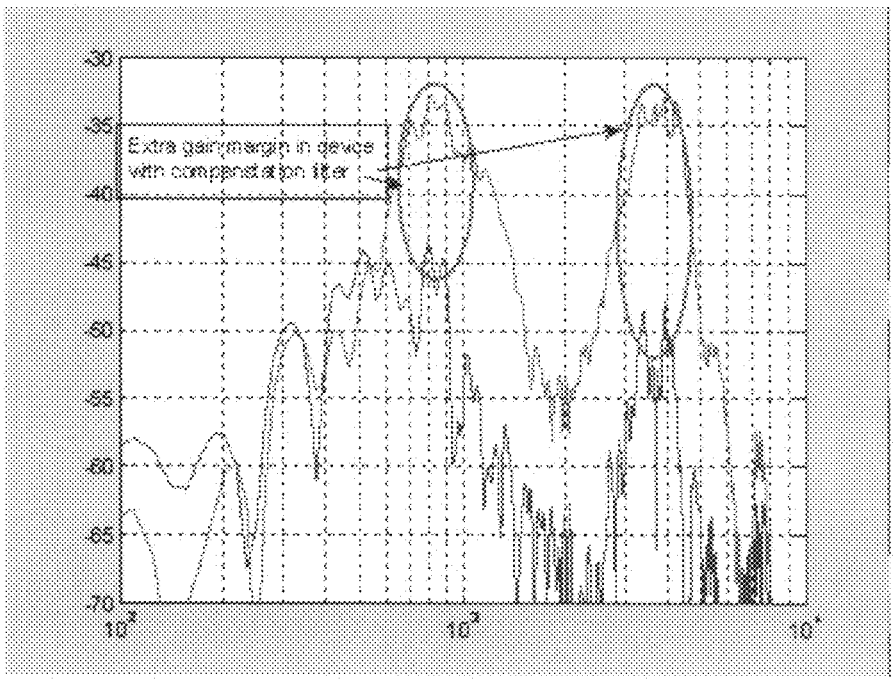

FIG. 1 shows a block-diagram of a typical hearing aid system with one feedback compensation filter, FIG. 2 shows a block-diagram of a hearing aid system with both internal and external feedback compensation filters, FIG. 3 shows the receiver mounted within a hearing aid housing in accordance with an embodiment, FIG. 4 shows the receiver mounted within a hearing aid housing in accordance with another embodiment, FIG. 5 shows the receiver mounted within a hearing aid housing in accordance with yet another embodiment, and FIG. 6 shows a plot of internal feedback signals with and without the first feedback compensation means.

DETAILED DESCRIPTION

A block-diagram of a typical (prior-art) hearing aid with a feedback compensation filter 106 is shown in FIG. 1. The hearing aid comprises a microphone 101 for receiving incoming sound and converting it into an audio signal. A receiver 102 converts output from the hearing instrument processor 103 into output sound, which is supposed to be modified to compensate for a users hearing impairment. Thus, the hearing instrument processor 103 comprises elements such as amplifiers, compressors and noise reduction systems etc.

A feedback path 104 is shown as a dashed line between the receiver 102 and the microphone 101. This feedback path makes it possible for the microphone 101 to pick up sound from the receiver 102 which may lead to well known feedback problems, such as whistling.

The (frequency dependent) gain response (or transfer function) H(ω) of the hearing aid (without feedback compensation) is given by:

$$H(\omega) = \frac{A(\omega)}{1 - F(\omega)A(\omega)} \tag{1}$$

where ω represents (angular) frequency, F(ω) is the gain function of the feedback path 104 and A(ω) is the gain function provided by the hearing instrument processor 103. When the feedback compensation filter 106 is enabled, it feeds a compensation signal to the subtraction unit 105, whereby the compensation signal is subtracted from the audio signal provided by the microphone 101 prior to processing in the hearing instrument processor 103. The transfer function now becomes:

$$H(\omega) = \frac{A(\omega)}{1 - (F(\omega) - F'(\omega))A(\omega)} \tag{2}$$

where F'(ω) is the gain function of the compensation filter 106. Thus, the better F'(ω) estimates the true gain function F(ω) of the feedback path, the closer H(ω) will be to the desired gain function A(ω).

As previously explained, the feedback path 104 is usually a combination of internal and external feedback paths.

A hearing aid according to a preferred embodiment is shown in FIG. 2. Again, the hearing instrument comprises a microphone 201, a receiver 202 and a hearing instrument processor 203. An internal feedback path 204*a* is shown as a dashed line between the receiver 202 and the microphone 201. Furthermore, an external feedback path 204*b* between the receiver 202 and the microphone 201 is shown (also dashed). The internal feedback path 204*a* comprises an acoustical connection, a mechanical connection or a combination of both acoustical and mechanical connection between the receiver 202 and the microphone 201. The external feedback path 204*b* is a (mainly) acoustical connection between the receiver 202 and the microphone 201. A first compensation filter 206 is adapted to model the internal feedback path 204*a* and a second compensation filter 207 is adapted to model the external feedback path 204*b*. The first 206 and second 207 compensation filters feed separate compensation signals to the subtracting units 205, whereby both feedback along the internal and external feedback paths 204*a*, 204*b* is cancelled before processing takes place in the hearing instrument processor 203.

The internal compensation filter 206 models the internal feedback path 204*a*, which is usually static or quasi-static, since the internal components of the hearing aid substantially do not change their properties regarding transmission of sound and/or vibrations over time. The internal compensation filter 206 may therefore be a static filter with filter coefficients derived from an open loop gain measurement, which is preferably done during production of the hearing aid. However, in some hearing aids, the internal feedback path 204*a* may change over time, e.g. if the receiver is not fixed and therefore is able to move around within the hearing aid housing. In this case, the internal compensation filter may preferably comprise an adaptive filter, which adapts to changes in the internal feedback path.

The external compensation filter 207 is preferably an adaptive filter which adapts to changes in the external feedback path 204*b*. These changes are usually much more frequent than the aforementioned possible changes in the internal feedback path 204*a*, and therefore the compensation filter 207 should adapt more rapidly than the internal compensation filter 206.

Because the length of the internal feedback path 204*a* is smaller than the length of the external feedback path 204*b*, the impulse response of the external feedback path 204*b* will be delayed in comparison to the impulse response of the internal feedback path 204*a* when these impulse responses are measured separately. The delay of the external feedback signal depends on the size and shape of the hearing aid, but will usually not exceed 0.25 ms (milliseconds). Typical delays are 0.01 ms, such as 0.02 ms, such as 0.03 ms, such as 0.04 ms, such as 0.05 ms, such as 0.06 ms, such as 0.07 ms, such as 0.08 ms, such as 0.09 ms, such as 0.1 ms, such as 0.11 ms, such as 0.12 ms, such as 0.13 ms, such as 0.14 ms, such as 0.15 ms, such as 0.16 ms, such as 0.17 ms, such as 0.18 ms, such as 0.19 ms, such as 0.2 ms, such as 0.21 ms, 0.22 ms, such as 0.23 ms, such as 0.24 ms.

The respective impulse responses of the internal and external feedback paths 204*a*, 204*b* also differ in signal level since the attenuation along the internal feedback path 204*a* usually exceeds the attenuation along the external feedback path 204*b*. Therefore, the external feedback signal will usually be stronger than the internal feedback signal.

In summary, the internal and external feedback compensation filters 206, 207 differ at least on the following three points:

1. Needed frequency of adaptation,
2. Position of impulse response in the time domain, and
3. Dynamic range of the impulse response.

Thus, if one single adaptive filter should replace the two compensation filters 206, 207, it would require a high amount of processing power due to the higher number of filter coefficients that would have to be computed with a high frequency of adaptation of the entire filter. Furthermore, precision may be sacrificed because of the differences in the dynamic range.

The internal compensation filter 206 is preferably programmed during production of the hearing aid. Thus, when the hearing aid has been assembled, a model of the internal feedback path is estimated. To get a good estimate of the internal feedback path 204, it is necessary to do a system identification of the hearing aid with a blocked external feedback path. One way to do this is to place the hearing instrument in a coupler (ear simulator) to provide a suitable acoustic impedance to the receiver, i.e. an impedance substantially equal to the impedance of a wearer's ear. Any leaks, such as vents in In-The-Ear (ITE) hearing instruments, must be sealed, so that all external feedback paths are eliminated. The hearing aid (and coupler) may further be placed in an anechoic test box to eliminate sound reflections and noise from the surroundings. Then a system identification procedure, such as an open-loop gain measurement, is performed to measure F(w), cf. equations (1) and (2) above. One way to perform this is to have the device play back an MLS sequence (Maximum Length Sequence) on the output 202 and record it on the input 201. From the recorded feedback signal the internal feedback path can be estimated. The filter coefficients for the obtained model is then stored in the device and used during operation of the hearing aid.

FIG. 3 illustrates the mounting of the receiver 302 in the hearing aid housing 310. The receiver 302 is fixed to the hearing aid housing 310 at the output port 312 of the hearing aid. The tip (not visible) of the receiver 302 is surrounded by a ring 314 constituting a support structure for the receiver and made of a material that attenuates the vibrations and the sound propagating from the receiver 302 to the hearing aid housing 310.

FIG. 4 illustrates another mounting of the receiver 402 in the hearing aid housing 410 having a support structure with tabs 416 for receiving and holding the receiver 402 within the hearing aid housing 410.

FIG. 5 illustrates yet another mounting of the receiver 502 in the hearing aid housing 510 having a compartment 518 that snugly fits the receiver 502. Further, the hearing aid tip 503 may be surrounded by a ring 514 constituting a further support structure for the receiver 502 and made of a material that attenuates the vibrations and the sound propagating from the receiver 502 to the hearing aid housing 510.

FIG. 6 is a plot of the open-loop gain of the hearing aid with and without the first feedback compensation means. Again, the hearing aid is positioned in a coupler (ear simulator) to provide an acoustic impedance to the receiver that is substantially similar to that provided by a wearer's ear. Leaks such as vents in In-The-Ear (ITE) devices were sealed, and the device was positioned in an anechoic test box to eliminate sound reflections and/or noise from the surroundings. The upper curve is a plot of the open-loop gain without first feedback compensation means for compensating mechanical and acoustical feedback within the hearing aid housing, and the lower curved is a corresponding plot of the open loop gain with the first feedback compensation means operating. It should be noted that the lower curve indicates an improved gain margin of 10 dB or more at the indicated open loop gain peaks. Thus, the first feedback compensation means makes an increased maximum gain available to the user of the hearing aid.

The invention claimed is:

1. A hearing aid comprising a hearing aid housing enclosing:

a microphone for converting sound into an audio signal, a first feedback compensation means for providing a first feedback compensation signal to compensate for internal mechanical feedback signals transmitted mechanically in the hearing aid and picked up by the microphone, a second feedback compensation means for providing a second feedback compensation signal to compensate for external feedback signals picked up by the microphone, a subtracting means for subtracting the first and second feedback compensation signals from the audio signal to form a compensated audio signal, a processing means, connected to an output of the subtracting means, for processing the compensated audio signal, and a receiver, connected to an output of the processing means, for converting the processed compensated audio signal into a sound signal.

2. The hearing aid according to claim 1, wherein the receiver is mounted in abutting contact with a supporting structure within the hearing aid housing.

3. The hearing aid according to claim 1, wherein the first feedback compensation means comprises a substantially static filter.

4. The hearing aid according to claim 1, wherein the first feedback compensation means comprises an adaptive filter.

5. The hearing aid according to claim 1, wherein the second feedback compensation means comprises an adaptive filter.

6. The hearing aid according to claim 1, wherein the first and second feedback compensation means operate on first and second time windows, respectively, and wherein at least a part of the first time window precedes the second time window.

7. The hearing aid according to claim 1, the hearing aid further comprising a test signal generator for generating a test signal for emission via the receiver, wherein the processing means comprises:

means for recording a feedback signal upon emission of the test signal, means for estimating, based on at least a part of said feedback signal, a model of at least a part of a corresponding feedback signal path, and means for transferring said estimated model to the first feedback compensation means.

8. The hearing aid according to claim 7, wherein the test signal is a broadband noise signal.

9. The hearing aid according to claim 7, wherein the test signal is a Maximum Length Sequence (MLS).

10. The hearing aid according to claim 1, wherein the first feedback compensation means is configured to provide the first feedback compensation signal by modeling an internal mechanical feedback signal path of the hearing aid; and wherein the second feedback compensation means is configured to provide the second feedback compensation signal by modeling an external feedback signal path of the hearing aid.

11. The hearing aid according to claim 10, wherein the external feedback signal path is an acoustic path between the microphone and the receiver.

12. The hearing aid according to claim 1, wherein the first feedback compensation means and the second feedback compensation means have different respective configurations that correspond with the internal mechanical feedback signals and the external feedback signals, respectively.

13. The hearing aid according to claim 1, wherein the first feedback compensation signal is configured to compensate for internal mechanical feedback signals transmitted mechanically in the hearing aid through air, through a component of the hearing aid, or through both.

14. A method for cancellation of feedback in a hearing aid, said hearing aid at least comprising a microphone and hearing aid processing means, the method comprising:

generating a first feedback compensation signal to compensate for internal mechanical feedback signals transmitted mechanically in the hearing aid, generating a second feedback compensation signal to compensate for external feedback signals, and subtracting the first and second feedback compensation signals from an audio signal provided by the microphone prior to feeding the audio signal to the hearing aid processing means.

15. The method of claim 14, wherein the first feedback compensation signal is generated by modeling an internal mechanical feedback signal path of the hearing aid; and wherein the second feedback compensation signal is generated by modeling an external feedback signal path of the hearing aid.

16. The method of claim 14, wherein the first feedback compensation signal is generated using a first feedback compensator, and the second feedback compensation signal is generated using a second feedback compensator, the first feedback compensator and the second feedback compensator having different respective configurations that correspond with the internal mechanical feedback signals and the external feedback signals, respectively.

17. The method of claim 14, wherein the first feedback compensation signal is generated to compensate for internal mechanical feedback signals transmitted mechanically in the hearing aid through air, through a component of the hearing aid, or through both.

18. A hearing aid comprising:

a hearing aid housing;

a microphone for converting sound into an audio signal;

a first feedback compensator for providing a first feedback compensation signal to compensate for internal mechanical feedback signals transmitted mechanically in the hearing aid and picked up by the microphone;

a second feedback compensator for providing a second feedback compensation signal to compensate for external feedback signals picked up by the microphone;

a subtracter for subtracting the first and second feedback compensation signals from the audio signal to form a compensated audio signal;

processing device, connected to an output of the subtracting means, for processing the compensated audio signal; and a receiver, connected to an output of the processing device, for converting the processed compensated audio signal into a sound signal;

wherein the first feedback compensator, the second feedback compensator, the subtracter, and the processing device are located within the hearing aid housing.

19. The hearing aid according to claim 18, wherein the receiver is mounted in abutting contact with a supporting structure within the hearing aid housing.

20. The hearing aid according to claim 18, wherein the first feedback compensator comprises a substantially static filter.

21. The hearing aid according to claim 18, wherein the first feedback compensator comprises an adaptive filter.

22. The hearing aid according to claim 18, wherein the second feedback compensator comprises an adaptive filter.

23. The hearing aid according to claim 18, wherein the first and second feedback compensators operate on first and second time windows, respectively, and wherein at least a part of the first time window precedes the second time window.

24. The hearing aid according to claim 18, further comprising a test signal generator for generating a test signal for emission via the receiver, wherein the processing device is configured for:

recording a feedback signal upon emission of the test signal, estimating, based on at least a part of said feedback signal, a model of at least a part of a corresponding feedback signal path, and transferring said estimated model to the first feedback compensator.

25. The hearing aid according to claim 24, wherein the test signal is a broadband noise signal.

26. The hearing aid according to claim 24, wherein the test signal is a Maximum Length Sequence (MLS).

27. The hearing aid according to claim 18, wherein the first feedback compensator is configured to provide the first feedback compensation signal by modeling an internal mechanical feedback signal path of the hearing aid; and wherein the second feedback compensator is configured to provide the second feedback compensation signal by modeling an external feedback signal path of the hearing aid.

28. The hearing aid according to claim 27, wherein the external feedback signal path is an acoustic path between the microphone and the receiver.

29. The hearing aid according to claim 18, wherein the first feedback compensator and the second feedback compensator have different respective configurations that correspond with the internal mechanical feedback signals and the external feedback signals, respectively.

30. The hearing aid according to claim 18, wherein the first feedback compensation signal is configured to compensate for internal mechanical feedback signals transmitted mechanically in the hearing aid through air, through a component of the hearing aid, or through both.

* * * * *